US005208084A

United States Patent [19]

Rutz

[11] Patent Number: 5,208,084

[45] Date of Patent: May 4, 1993

[54] EDGE PAD

[76] Inventor: Almer J. Rutz, Box 816, Riverdale, N. Dak. 58565

[21] Appl. No.: 703,454

[22] Filed: May 21, 1991

[51] Int. Cl.[5] ..... A61F 13/02

[52] U.S. Cl. ..... 428/40; 428/68; 428/74; 428/76; 428/121; 428/131; 428/134; 428/192; 428/343; 428/354; 248/345.1; 248/346.1; 52/288; 52/821; 52/822; 52/829; 108/27; 108/90; 108/161

[58] Field of Search ..... 428/192, 40, 68, 76, 428/74, 131, 134, 343, 354, 121; 248/345.1, 346.1; 108/27, 90, 161; 312/137, 229, 277; 52/821, 822, 827, 828, 829, 288

[56] References Cited

U.S. PATENT DOCUMENTS

| | | | |
|---|---|---|---|
| 3,173,826 | 3/1965 | Campbell | 248/345.1 |
| 3,725,188 | 4/1973 | Kalt | 248/345.1 |
| 3,960,354 | 6/1976 | Simikoski | 248/345.1 |
| 4,514,871 | 5/1985 | Fisher | 248/345.1 |
| 4,817,902 | 4/1989 | Mason | 248/345.1 |
| 4,903,686 | 2/1990 | Jennings | 248/345.1 |
| 5,058,566 | 10/1991 | Dabbs | 52/288 |

FOREIGN PATENT DOCUMENTS

| | | | |
|---|---|---|---|
| 984651 | 3/1965 | United Kingdom | 248/345.1 |

*Primary Examiner*—Ellis P. Roninson
*Assistant Examiner*—Nasser Ahmad
*Attorney, Agent, or Firm*—Merchant, Gould, Smith, Edell, Welter & Schmidt

[57] ABSTRACT

A pad (10) is adapted for attachment to an edge (18) of a countertop or desk (12). The pad (10) is constructed of a frame (28) extending over two surfaces of the desk (12) and is covered with cushioning (30) and a cover (36). The pad (10) attaches with adhesive strips (38) mounted directly on the frame (28) for attaching to the top (14) of the desk (12).

11 Claims, 3 Drawing Sheets

EDGE PAD

BACKGROUND OF THE INVENTION

1. Field of the Invention

The present invention relates to a pad device which covers an edge of a desk, table, countertop or the like for protecting forearms which are resting on the edge.

2. Description of the Prior Art

Edges of desks, tabletops, counters and the like cause numerous problems for people having body parts resting against the edge. The edges may be quite sharp to arms which rub and chafe against the edge and cause added discomfort when the bony portion of the forearms rub against the edge. This problem is especially troublesome for typists or persons operating a keyboard, wherein the bone of the forearm is placed directly against the edge and the typing requires constant moving of the arms, causing substantial rubbing against the edge. The sharp edge may also cause discomfort when leaning over the edge wherein the edge engages the stomach or ribs. In addition to physical discomfort due to rubbing, the edge also may cause additional wear on clothing which rubs against the edge or wear on chairs which bump against the edge.

As an alternative to rubbing on the edge, the arms must be held above the edge of the desk. In addition to fatigue, the strain due to holding the arms above the desk along with repetitive movements can lead to injuries for workers. In particular, those working at keyboards may likely develop carpal tunnel syndrome. Adequate support and cushioning at the edge of the desk so workers could comfortably rest their arms on the edge would alleviate these problems.

In an effort to prevent discomfort due to rubbing or lifting arms off the desk, forearm pads may be worn by the worker to provide cushioning. A pillow or pad may be placed against the edge. However, the pads or pillows are often too cumbersome and slide around, getting in the way.

It can be seen then, that a device is needed which provides protection around sharp edges and provides cushioning and support. It can be seen that a pad should be securable in place around the edges and does not get in the way of a user.

SUMMARY OF THE INVENTION

The present invention is directed to a pad device for mounting on an edge of a desk or countertop. The pad covers a portion of the top of a desk and a portion of the side of the desk to provide cushioning, support and protection for a person's forearms that would otherwise rub against the edge of the desk. The pad has an inner frame portion and cushioning mounted thereon. A covering is wrapped over the frame and cushioning and glued thereto. The covering wraps over the frame and cushioning but is configured so that the covering does not overlap at any point. Adhesive is mounted directly to the frame for attaching the pad to the top surface of the desk.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
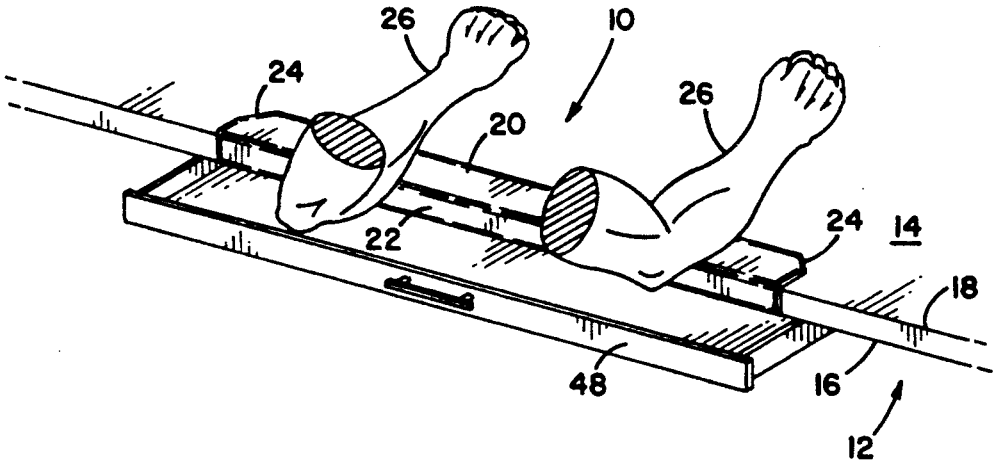
FIG. 1 is a top perspective view of a first embodiment of an arm pad device mounted on an edge of a desk according to the principles of the present invention.

Referring now to the drawings, and in particular to FIG. 1, there is shown a first embodiment of an arm pad device 10 mounted on an edge 18 of a desk 12. The pad 10 provides for cushioning exposed edges so that forearms and other body parts do not rub against the edge 18. The pad 10 has a first planar portion 20 covering a portion of a desktop 14 and a second planar portion 22 covering a portion of a side 16 of the desk 12. Reference will be made throughout the description to a desk 12, desktop 14, side 16 and the edge 18 of the top 14 and the side 16. However, it is understood that the pad 10 may be placed on any edge of two surfaces at a substantially right angle. The first planar portion 20 has obtuse angled corners 24 rather than squared corners which are less likely to catch on clothing, jewelry and objects placed on the desk 12 and which also provide for improved covering, as explained hereinafter. The second planar portion 22 extends over only a narrow portion of the side 16, so that if the pad 10 is mounted on a desk 12, drawers 48 can still be opened without the pad 10 getting in the way.

Figure 2:
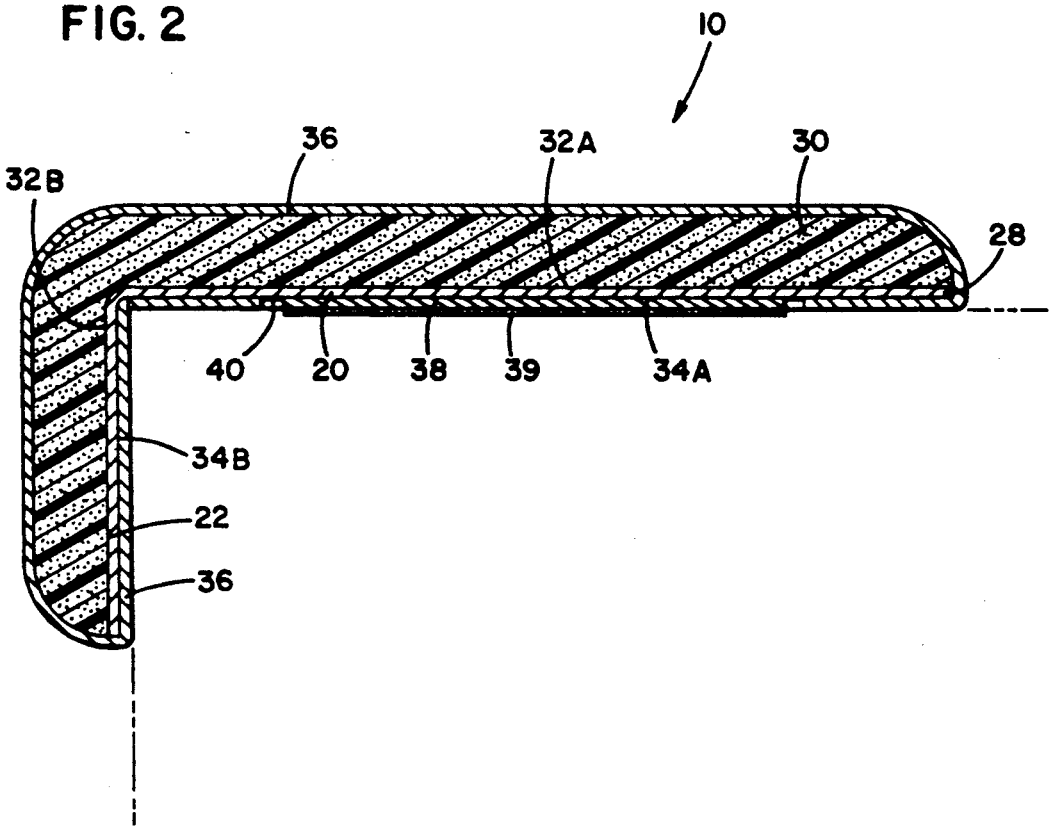
FIG. 2 is a side sectional view taken along line 2—2 of the arm pad shown in FIG. 1.

Referring now to FIG. 2, the pad 10 is constructed around a central frame 28. In the preferred embodiment, the frame 28 is a rigid right angle piece, such as, for example, angle iron, which extends along the first planar portion 20 and the second planar portion 22. The frame 28 underlies cushioning 30 which is glued to outer faces **32*a* and 32*b* of the frame 28 to provide comfortable support. A cover 36, which is made of leather, naugahyde or similar material in the preferred embodiment, is wrapped over and glued to the frame 28 and cushioning 30**, as explained hereinafter.

Figure 3:
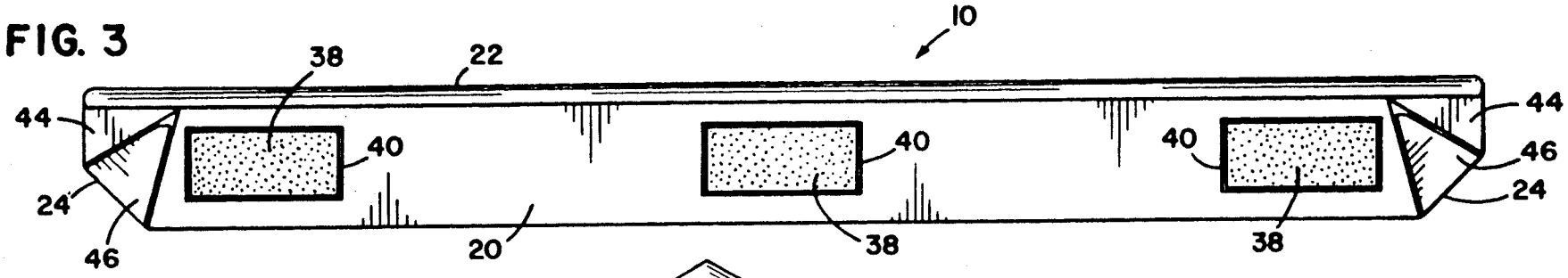
FIG. 3 is a bottom view of the arm pad shown in FIG. 1.

The pad 10 may be placed on the desk 12 covering the edge 18 so that it rests there and can be easily moved or removed. However, the pad 10 can also be anchored to the desk 12 with adhesive, as shown in FIGS. 2 and 3. In the preferred embodiment, adhesive strips 38 are attached directly to the inner face **34*a* of the frame 28 at openings 40 in the covering 36. In this manner, the adhesive strips 38 make a direct contact between the frame 28 and the desk 12. This direct mounting method to the frame 28 avoids flexure between the adhesive 38 and the pad 10 which would occur if mounted to the somewhat spongy covering 36 which may weaken the bond between the pad 10 and the desk 12. The direct bonding to the frame 28 provides for improved attachment to the desk 12 with reduced relative movement. If the pad 10 is not anchored to the desk 12, release liners 39 are left covering the adhesive strips 38 so that the pad 10 does not adhere to the desk 12. To mount the padding device 10 to the desk 12, the release liners 39 are removed and the padding device is placed in the desired location. Pressure is then applied so the adhesive strips 38 are pressed against the desktop 14, thereby anchoring the padding device 10 to the desk 12**.

Figure 4:
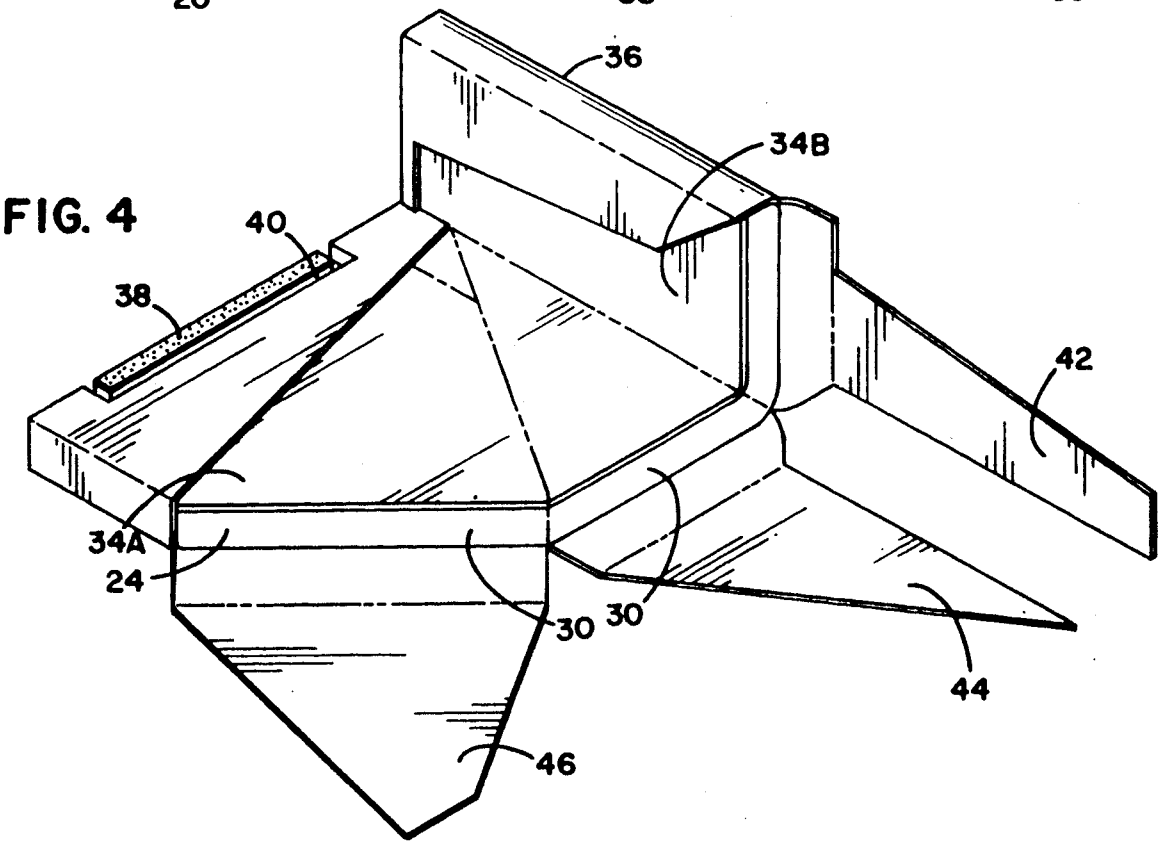
FIG. 4 is a detailed perspective bottom view of an end of the arm pad prior to folding tab portions of the cover into the final position.

The cover 36 is cut, as shown in FIG. 4, so that upon folding, the cover wraps over the frame 28 and cushioning 30 so that the surface is covered, but so that the covering 36 does not overlap at any point. The angled corners 24 provide for cutting tabs in the cover 36 for folding onto the frame 28 and the cushioning 30 so that no overlapping occurs. The covering 36 is folded over the planar portions 20 and 22 so that the openings 40 are placed on the inner surface 34*a* of planar portion 20, as shown in FIGS. 2 and 3. For improved appearance and full coverage, the covering 36 is cut with relief cuts forming tabs 42, 44 and 46, as shown in FIG. 4. The tabs 42, 44 and 46 are tapered so that when folded, the tabs cover the ends of surfaces 34*a* and 34*b* and meet, but do not overlap, as shown in FIG. 3. The seams are hidden when the arm pad 10 is in use.

Figure 5:
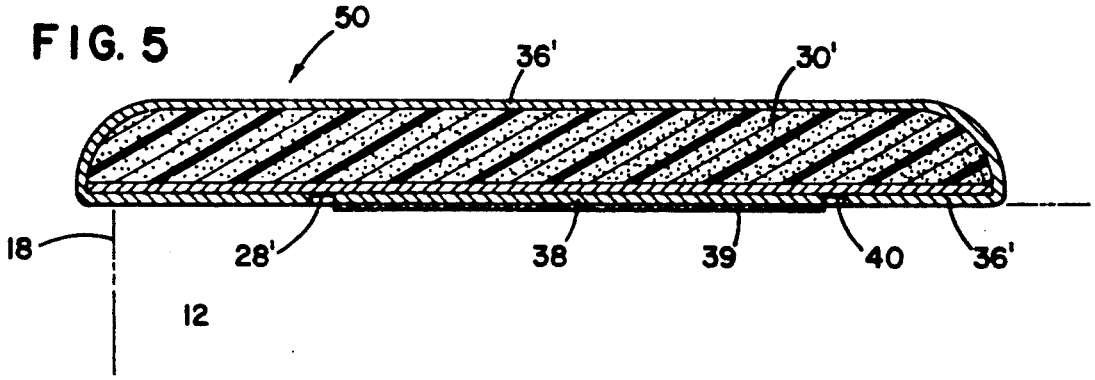
FIG. 5 is a sectional view of a second embodiment of an arm pad device mounted at an edge of a desk; and, FIG. 6 is a bottom view of the arm pad device shown in FIG. 5.
Figure 6:
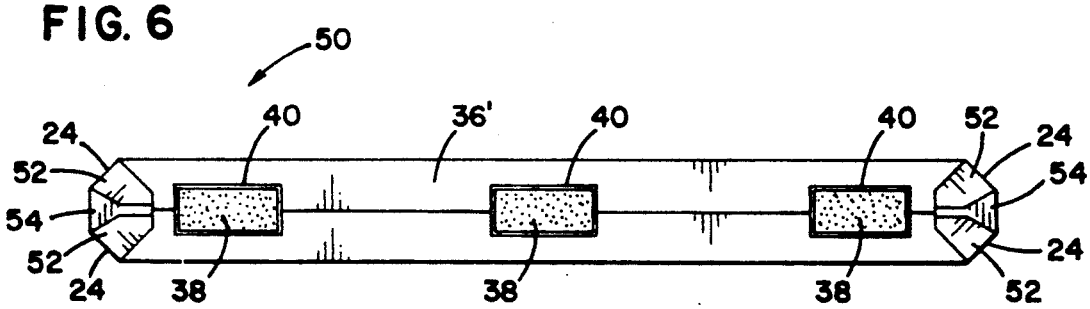

Referring now to FIG. 5, there is shown a second embodiment of an arm pad device 50. The second embodiment covers only one edge of a desk or counter 12. However, when placed proximate the edge 18, the arm pad 50 provides cushioning and support for arms which would otherwise rest against the edge 18. The arm pad 50 has a frame 28' which is a rigid planar piece and has cushioning 30' glued thereon. A cover 36, wraps around the frame 20' and the cushioning 30'. As shown in FIG. 6, the arm pad 50 has obtuse angled corners 24 which are less likely to catch on clothing, jewelry and desk objects. The obtuse angle corners 24 also provide for improved covering. The cover 36' is folded over from the top and has the ends cut to form tapered tabs 52 and 54. Upon folding the tabs 52 and 54 over the cushioning 30, and around to the bottom of the frame 28', the tabs 52 and 54 cover substantially all of the arm pad 50. The seams are hidden underneath the arm pad 50 for improved appearance.

As shown in FIGS. 5 and 6, the arm pad 50 has adhesive strips 38 attached directly to the frame 28' at openings 40 in the covering 36'. In this manner, the adhesive strips 38 make direct contact between the frame 28' and the desk or countertop 12. As explained above, this direct mounting method avoids flexure between the adhesive 38 and the pad 50 which would occur if the adhesive 38 were mounted to the somewhat spongy covering 36' and reduces the movement of the pad 50 relative to the desk 12. Should it be desired to place the pad 50 on the desk or countertop 12 without attaching the arm pad 50, adhesive liners 39 are left on the adhesive strips 38, so that the arm pad 50 does not stick to the desk 12.

It can be appreciated that one or more arm pads 10 and 50 may be used in various combinations to provide padding as required. Pads may be placed with a space between them so that each arm rests on a pad while the center portion remains open. This may be particularly useful for bank tellers wherein change must be slid from the counter. It can also be appreciated that the length and width of the arm pads 10 and 50 may be varied for various applications.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An edge padding device for covering an exposed edge of two intersecting surfaces, comprising:

rigid frame means for providing a structure adapted for fitting over at least one of the intersecting surfaces;

padding means for providing cushioning over the frame means, the padding means covering surfaces of the frame which are not facing the intersecting surfaces;

adhesive means for attaching the padding device to at least one of the intersecting surfaces wherein the adhesive means comprise an adhesive mounted to the frame means and having an exposed surface for sticking to at least one of the intersecting surfaces; and, covering means for covering the padding means and the frame and glued thereto, wherein the covering means includes openings formed therethrough for placing the adhesive means.

2. A padding device according to claim 1, wherein the frame means comprises a length of angle iron.

3. A padding device according to claim 1, wherein the padding means covers only enough of an edge so that when placed on a desktop, the padding device does not interfere with drawers.

4. A padding device according to claim 1, wherein a portion of the device extending over a first surface has an angled corner portion with obtuse angles between the sides of the portion covering the first surface.

5. A padding device according to claim 1, wherein the covering means is applied in a single non-overlapping layer.

6. An edge padding device for covering an exposed edge of two intersecting surfaces, comprising:

rigid frame means for providing a structure adapted for fitting over at least one of the intersecting surfaces;

padding means for providing cushioning over the frame means;

adhesive means for attaching the padding device to at least one of the intersecting surfaces, wherein the adhesive means comprise an adhesive mounted to the frame means and having an exposed surface for sticking to at least one of the intersecting surfaces; and, covering means for covering the padding means and the frame means, wherein the covering means covers all surfaces of the cushioning means and the frame means and glued thereto, the covering means having openings for placement of the adhesive means.

7. An edge padding device for covering an exposed edge of two intersecting surfaces, comprising:

a rigid frame portion for providing a structure adapted for fitting over at least one of the intersecting surfaces and glued thereto, the covering means have openings for the placement of the adhesive means wherein the frame portion has corners which have obtuse angles;

padding means for providing cushioning over the frame means;

adhesive means for attaching the padding device to at least one of the intersecting surfaces; and, covering means for covering the padding means and the frame means applied in a single non-overlapping layer.

8. A padding device according to claim 7, wherein the covering means is configured to form tabs, the tabs folding over each edge at the corner obtuse angles so that the tabs do not overlap.

9. A padding device according to claim 6, further comprising removable adhesive covering means.

10. A padding device according to clam 1, further comprising removable adhesive covering means.

11. A padding device according to claim 10, wherein the removable adhesive covering means comprise adhesive liners covering the adhesive.

* * * * *